US008864947B2

(12) United States Patent
Zhu et al.

(10) Patent No.: US 8,864,947 B2
(45) Date of Patent: Oct. 21, 2014

(54) VERTICAL PYROLYSIS EQUIPMENT FOR COAL MATERIAL

(75) Inventors: Shucheng Zhu, Nanyang (CN); Xibin Wang, Nanyang (CN); Xiangyun Huang, Nanyang (CN); Guochao Cao, Nanyang (CN); Wei Liu, Nanyang (CN)

(73) Assignee: Xixia Dragon Into Special Material Co., Ltd. (CN)

( * ) Notice: Subject to any disclaimer, the term of this patent is extended or adjusted under 35 U.S.C. 154(b) by 31 days.

(21) Appl. No.: 13/813,708

(22) PCT Filed: Sep. 19, 2010

(86) PCT No.: PCT/CN2010/077086

§ 371 (c)(1),
(2), (4) Date: Feb. 1, 2013

(87) PCT Pub. No.: WO2012/022061

PCT Pub. Date: Feb. 23, 2012

(65) Prior Publication Data

US 2013/0126330 A1 May 23, 2013

(30) Foreign Application Priority Data

Aug. 19, 2010 (CN) ..... 2010 1 0262918

(51) Int. Cl.

| | |
|---|---|
| ***C10B 1/04*** | (2006.01) |
| ***C10B 47/34*** | (2006.01) |
| ***C10K 1/02*** | (2006.01) |
| ***C10B 47/20*** | (2006.01) |
| ***C10K 1/04*** | (2006.01) |
| ***C10B 21/20*** | (2006.01) |
| ***C10B 53/04*** | (2006.01) |

(52) U.S. Cl.

CPC . *C10B 21/20* (2013.01); *C10B 1/04* (2013.01); *C10K 1/02* (2013.01); *C10B 47/20* (2013.01); *C10K 1/04* (2013.01); *C10B 47/34* (2013.01); *C10B 53/04* (2013.01)

USPC ..... 202/126; 202/221; 202/241

(58) Field of Classification Search

CPC ..... C10B 1/04; C10B 47/34; C10B 53/04; C10B 47/20; C10B 21/20; C10K 1/04; C10K 1/02

USPC ..... 201/2; 202/120, 126, 221, 241

See application file for complete search history.

(56) References Cited

U.S. PATENT DOCUMENTS 2,200,371 A * 5/1940 Koppers ..... 202/123
2,622,061 A * 12/1952 Horner et al. ..... 202/120

(Continued)

FOREIGN PATENT DOCUMENTS

CN 2627438 Y 7/2004
CN 2847194 Y 12/2006

(Continued)

OTHER PUBLICATIONS

International Search Report for PCT/CN2010/077086, mail date May 5, 2011.

*Primary Examiner* — Nina Bhat
*Assistant Examiner* — Jonathan Miller
(74) *Attorney, Agent, or Firm* — Rossi, Kimms & McDowell LLP

(57) ABSTRACT

Disclosed is a vertical pyrolysis equipment for coal material, which comprises an enclosed kiln body with an inlet and an outlet, a flame-gas heating pipelines provided inside the kiln body, coal material propulsion and pyrolysis passage formed between the flame-gas heating pipelines and inner wall of the kiln body, coal pyrolysis gas collecting tube communicated with the coal material propulsion and pyrolysis passage provided on the kiln. The heat generated by flame-gas heating pipelines is conducted and radiated to coal powder in the coal material propulsion and pyrolysis passage. The coal powder sufficiently absorbs the heat and is pyrolyzed into fuel gas, tar gas and coal with high heat value inside the coal material propulsion and pyrolysis passage. The pyrolyzed fuel gas and tar gas are transferred to the gas dedusting-liquifying mechanism outside the kiln through the connecting coal pyrolysis gas collecting tube for collecting, dedusting, separating and high-pressure liquefying.

17 Claims, 3 Drawing Sheets

(56) References Cited

U.S. PATENT DOCUMENTS

| | | | | |
|---|---|---|---|---|
| 3,621,506 | A * | 11/1971 | Armstrong et al. | 15/246 |
| 4,374,704 | A * | 2/1983 | Young | 202/117 |
| 5,082,534 | A * | 1/1992 | Breu | 202/131 |
| 5,225,044 | A * | 7/1993 | Breu | 202/113 |
| 7,625,532 | B2 * | 12/2009 | Bridgwater et al. | 422/198 |
| 8,323,455 | B1 * | 12/2012 | Jones et al. | 202/241 |
| 8,444,828 | B2 * | 5/2013 | Wolfe | 201/15 |
| 8,603,404 | B2 * | 12/2013 | Pinatti et al. | 422/198 |
| 2012/0184797 | A1 * | 7/2012 | Rispoli et al. | 588/312 |

FOREIGN PATENT DOCUMENTS

| | | | |
|---|---|---|---|
| CN | 2867240 | Y | 2/2007 |
| CN | 201034412 | Y | 3/2008 |

* cited by examiner

VERTICAL PYROLYSIS EQUIPMENT FOR COAL MATERIAL

This application is a U.S. National Phase Application of PCT International Application PCT/CN2010/077086 filed on Sep. 19, 2010, which is based on and claims priority from CN 201010262918.5 filed on Aug. 19, 2010 the contents of which is incorporated in its entirety by reference.

FIELD OF THE INVENTION

The invention relates to a comprehensive utilization of coal material for energy saving and emission reduction, particularly relates to a vertical pyrolysis equipment for coal material.

BACKGROUND OF THE INVENTION

In conventional technology, coal is used to produce coal gas, natural gas, or used to produce gas by coking at high temperature, medium temperature or low temperature. However, the above-mentioned technology is required to form pulverized coal into blocks or sift lump coal, which increases the cost of raw material, or result in the produced gas without a high heat value, a big additional value, and a significant economic and social benefits.

The heating mode of furnace can be classified as external-heating mode, internal-heating mode and hybrid-heating mode. The heating medium in external-heating furnace is not contact directly with raw materials and heat is transferred from furnace wall. The heating medium in the internal-heating furnace contacts with the raw materials directly, and the heating methods are classified as solid heat carrier mode and gas heat carrier mode according to different heat mediums.

The method in internal heating mode and gas heat carrier mode is a typical method used in the industry. This method uses a vertical continuous furnace in internal heating mode and gas heat carrier mode, which includes three parts from top to bottom: a drying section, a decomposition section and a cooling section. Lignite coals or their compressed blocks (about 25~60 mm) move from top to bottom to countercurrent contact with the combustion gas directly so as to be heated for decomposition at low temperature. When a moisture content of raw material in furnace roof is about 15%, the raw material should be dried in the drying section to attain a moisture content below 1.0%, and the upstream hot combustion gas at about 250 degrees centigrade is cooled to a temperature at 80~100 degrees centigrade. Thereafter, the dried raw material is heated to about 500 degrees centigrade by the oxygen-free combustion gas at 600~700 degrees centigrade in the decomposition section to be decomposed. The hot gas is cooled to about 250 degrees centigrade, and the produced semi-coke is transferred to the cooling section and cooled by cool gas. Thereafter, the semi-coke is discharged and further cooled by water and air. The volatiles escaped from the decomposition section are subjected to condensation, cooling steps and the like to attain tar and pyrolysis water. This kind of furnace has ever built in the Germany, United States, Soviet Union, Czechoslovakia, New Zealand and Japan.

The method in internal heating mode and solid heat carrier mode is a typical method of internal heating style. The raw materials are lignite coal, non-caking coal, weakly-caking coal and oil shale. In the 1950s, there is an intermediate testing apparatus built with a processing capacity of 10 t/h coal in Dorsten of Federal Republic of Germany, and the used heat carrier are solid particles (small ceramic balls, sands or semi-cokes). Since the process product gas does not include exhaust gas, the equipment for later processing system has a smaller size and the gas has a higher heat value up to 20.5~40.6 MJ/m3. The method has a large processing capacity because of its large temperature difference, small particles and fast heat transfer. The resulting liquid products constitutes a majority and the yield can be up to 30% when processing high-volatile coal. The technical process of L-R method for low-temperature coal decomposition is firstly mixing the preheated small blocks of raw coals with the hot semi-coke from separator in the mixer so as to initiate a thermal decomposition. Then, they are falling into the buffer, and staying a certain time to complete the thermal decomposition. The semi-cokes from buffer come into the bottom of a riser, and are transmitted by hot air and burned off the residual carbon therein in riser at the same time so as to raise the temperature, and then the semi-coke is introduced into the separator for gas-solid separation. After that, the semi-cokes are returned to the mixer, and so circulated. A high heat value gas can be attained from the escaped volatiles from the mixer after dedusting, condensation, cooling and recycling oils.

At present, there are two kinds of conventional coal decomposition apparatus, one of which has an shaft kiln structure. The shaft kiln structure is used for combusting flue gas and combustible gases produced by coal, which has low gas purity and a low additional value, as well as partially discharge of gas. This results in a significant resources wasting and environmental pollution. Another kind of coal decomposition equipment has a shaft kiln structure. In such structure, coal lumps are placed on clapboard with holes, and a heater is provided above the coal lumps. Because the coal lumps on the clapboard are accumulated to a certain thickness, so they cannot be uniformly heated and decomposed, and are required to be cyclically heated and decomposed by the decomposed gas, wherein coal lumps are decomposed with a lower rate than that of pulverized coal. More importantly, since the presence of large amount of holes for ventilation and circulatory function provided on the clapboard, pulverized coal can leak through the holes. To avoid this, it is necessary to process the pulverized coal into coal briquette when introducing it into the shaft kiln. Thus, it will increase the cost of pulverized coal decomposition, and reduce the economic benefits because the pulverized coal cannot be directly used for coal decomposition in shaft kiln.

SUMMARY OF THE INVENTION

To solve the above problems present in prior arts, provided is a vertical pyrolysis equipment for coal material, by which the pulverized coal can be separated directly and thus improving their overall utilization value and saving energy, and so as to enhance its economic and social benefits.

According to an embodiment of the invention, this invention relates to a vertical pyrolysis equipment for coal material, which comprises: an enclosed kiln body with an inlet and an outlet, a flame-gas heating pipelines provided inside the kiln body, a coal material propulsion and pyrolysis passage formed between the flame-gas heating pipelines and inner wall of the kiln body, a coal pyrolysis gas collecting tube communicated with the coal material propulsion and pyrolysis passage provided on the kiln, wherein the coal pyrolysis gas collecting tube is connected with a gas dust-trapping and liquefying device which is arranged outside the kiln body, and the flame-gas heating pipelines is rotatably arranged relative to the shaft kiln body and a rotary scraper is arranged in the inner wall of the kiln body.

According to an embodiment of the invention, the flame-gas heating pipelines comprise a fuel supply pipe, an air supply pipe, a combustion chamber and radiator pipes for flame-gas, wherein the end away from the combustion chamber forms a flame collection tube that extends outside the vertical kiln body.

According to an embodiment of the invention, the radiator pipes for flame-gas are close-packed, the air supply pipe is communicated with the air distributary pipe, the fuel supply pipe is communicated with the fuel distributary pipe, the air distributary pipe is arranged parallel to the fuel distributary pipe and together with the combustion chamber to form a combustion unit, and the end of fuel distributary pipe close to the combustion chamber is communicated with the air distributary pipe.

According to an embodiment of the invention, the flame-gas heating pipelines comprise radiator pipes for flame-gas which are connected with the combustion chamber, the fuel supply pipe and the air supply pipe arranged outside the vertical kiln body.

According to an embodiment of the invention, the coal pyrolysis gas collecting tube is communicated with the fuel supply pipe at the lower part of vertical kiln though a small diameter pipe having a valve, and one side of the fuel supply pipe is further provided with a starting fuel tank having a valve.

According to an embodiment of the invention, the end of flame collection tube away from the radiator pipes for flame-gas is connected with a preheating and drying mechanism for pulverized coal.

According to an embodiment of the invention, the radiator pipes for flame-gas are close-packed According to the present invention, a novel heating method is introduced into pulverized coal decomposition field, such that a large amount of heat produced by the flame-gas heating pipelines are conducted and radiated to the pulverized coal in the coal material propulsion and pyrolysis passage. Thus, the pulverized coal can fully absorb the heat so as to be heated for being decomposed into the gas, coal tar gas and coal with high heat-value in the channel. The gas and coal tar gas are communicated with a gas dedusting and liquefaction facility external to the kiln body through the coal decomposition gas collecting tube, and the decomposed gas and coal tar gas are collected, dedusted, separated, and liquefied. The radiator pipes for flame-gas are a plurality of close-packed pipes in cylinder reticulation, such that the heat generated is more fully transferred to the pulverized coal. The coal pyrolysis gas collecting tube is communicated with the fuel supply pipe at the other side of vertical kiln though a small diameter pipe having a valve, and one side of the fuel supply pipe is further provided with a starting fuel tank having a valve. In such arrangement, a portion of combustible gas generated here can be easily supplied to the pulverized coal, and form a self-contained fuel supply and demand system, which can start the fuel tank to provide starting fuel for the kiln when the fuel gas is not generated kiln during fuel kiln start-up phase. The end of flame collection tube away from the radiator pipes for flame-gas is connected with a preheating and drying mechanism for pulverized coal, which ensure the large amount of residual heat present in the flame gas after passing over flame gas collecting pipe is pre-absorbed by pulverized coal, thereby the pulverized coal is dried and heated to improve the utilization of energy, which significantly increase the temperature of the pulverized coal before entering into the rotary kiln, and reduce the water content of the pulverized coal. The pyrolysis equipment for coal material disclosed by the present invention enable the decomposition and separation of the pulverized coal faster and more efficient so as to save and fully utilize energy and greatly increase the utilization rate and level of coal resources, thus it will produce a significant economic and social benefits for the entire society.

BRIEF DESCRIPTION OF THE DRAWINGS

The accompanying drawings facilitate an understanding of the various embodiments of this invention, in which.

DETAILED DESCRIPTION OF THE INVENTION

Embodiment 1

Figure 1:
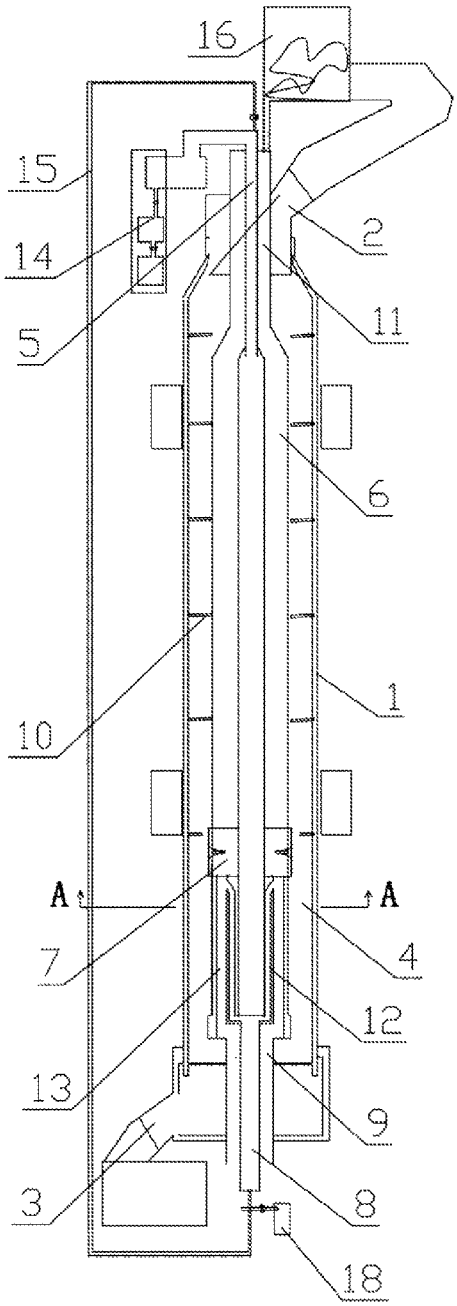
FIG. 1 is a schematic diagram according to a first embodiment of the present invention.
Figure 2:
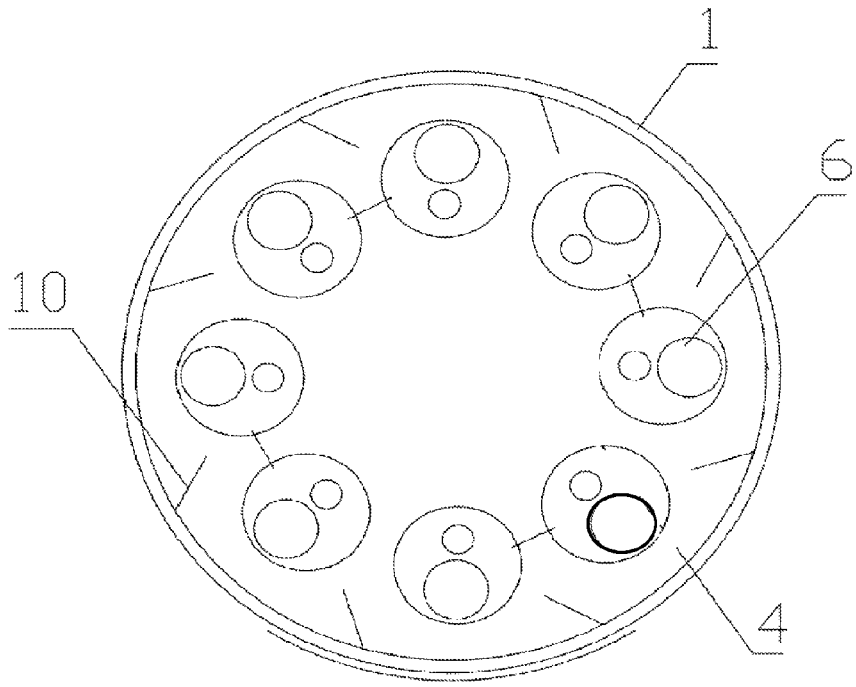
FIG. 2 is a sectional view of the line A-A in FIG. 1 of the present invention.

As shown in FIGS. 1 and 2, a vertical pyrolysis equipment for coal material comprises an enclosed kiln body 1 with an inlet 2 and an outlet 3, wherein the kiln body 1 is a shaft kiln structure. Flame-gas heating pipelines are provided inside the kiln body 1. A coal material propulsion and pyrolysis passage 4 is formed between the flame-gas heating pipelines and inner wall of the kiln body 1. A coal pyrolysis gas collecting tube 5 communicated with the coal material propulsion and pyrolysis passage 4 is provided on the kiln body 1, wherein the coal pyrolysis gas collecting tube 5 is connected with a gas dust-trapping and liquefying device 14 which is arranged outside the kiln body 1, and the flame-gas heating pipelines is rotatably arranged relative to the shaft kiln body 1 and a rotary scraper 10 is arranged in the inner wall of the kiln body 1. The flame-gas heating pipelines comprise radiator pipes 6 for flame-gas, a combustion chamber 7, a fuel supply pipe 8, and an air supply pipe 9, wherein the end away from the combustion chamber 7 forms a flame collection tube 11 that extends outside the vertical kiln body 1. The radiator pipes 6 for flame-gas are close-packed, the air supply pipe 9 is communicated with the air distributary pipe 13, the fuel supply pipe 8 is communicated with the fuel distributary pipe 12, the air distributary pipe 13 is arranged parallel to the fuel distributary pipe 12 and together with the combustion chamber 7 to form a combustion unit, and the end of fuel distributary pipe 12 close to the combustion chamber 7 is communicated with the air distributary pipe 13. The coal pyrolysis gas collecting tube 5 is communicated with the fuel supply pipe 8 at the lower part of vertical kiln 1 though a small diameter pipe 15 having a valve, and one side of the fuel supply pipe 8 is further provided with a starting fuel tank 18 having a valve. The end of collection tube 11 away from the radiator pipes 6 for flame-gas is connected with a preheating and drying mechanism 16 for pulverized coal. The radiator pipes 6 for flame-gas are a plurality of close-packed pipes in cylinder reticulation, such that the heat generated is more fully transferred to the pulverized coal. The fuel in the fuel supply pipe 8 is mixed with the air supply pipe 9 in the combustion chamber 7, and flame-gas at high temperature generated after the combustion enter into the radiator pipes 6, which transfer the heat to the pulverized coal in the coal material propulsion and pyrolysis passage 4. Thus, the pulverized coal can fully absorb the heat so as to be heated for being decomposed into the gas, coal tar gas and coal with high heat-value in the passage 4. The gas and coal tar gas are communicated with a gas dedusting and liquefaction facility external to the kiln body 1 through the coal decomposition gas collecting tube 5.

Embodiment 2

Figure 3:
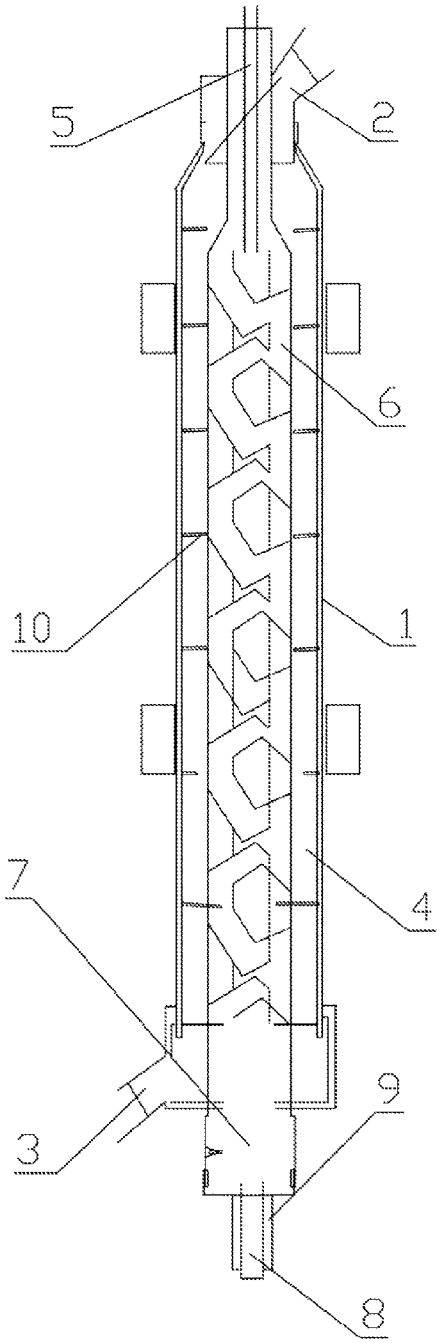
FIG. 3 is a schematic diagram according to a second embodiment of the present invention.

As shown in FIG. 3, a vertical pyrolysis equipment for coal material comprises an enclosed kiln body 1 with an inlet 2 and an outlet 3, wherein the kiln body 1 is a shaft kiln structure. Flame-gas heating pipelines are provided inside the kiln body 1. A coal material propulsion and pyrolysis passage 4 is formed between the flame-gas heating pipelines and inner wall of the kiln body 1. A coal pyrolysis gas collecting tube 5 communicated with the coal material propulsion and pyrolysis passage 4 is provided on the kiln body 1. The flame-gas heating pipelines are rotatably arranged relative to the shaft kiln body 1 and a rotary scraper 10 is arranged in the inner wall of the kiln body 1. The flame-gas heating pipelines comprise radiator pipes 6 for flame-gas which is connected with a combustion chamber 7, a fuel supply pipe 8, and an air supply pipe 9. The radiator pipes 6 for flame-gas are a plurality of close-packed pipes in cylinder reticulation, such that the heat generated is more fully transferred to the pulverized coal. The fuel in the fuel supply pipe 8 is mixed with the air in the air supply pipe 9 in the combustion chamber 7, and flame at high temperature generated after the combustion enter into the radiator pipes 6, which transfer the heat to the pulverized coal in the coal material propulsion and pyrolysis passage 4. Thus, the pulverized coal can fully absorb the heat so as to be heated for being decomposed into the gas, coal tar gas and coal with high heat-value in the passage 4. The gas and coal tar gas are communicated with a gas dedusting and liquefaction facility external to the kiln body 1 through the coal decomposition gas collecting tube 5.

What is claimed is:

1. A vertical pyrolysis equipment for coal material comprising:

an enclosed kiln body with an inlet and an outlet;

a flame-gas heating pipeline provided inside the shaft kiln body;

a coal material propulsion and pyrolysis passage formed between the flame-gas heating pipeline and an inner wall of the kiln body;

a coal pyrolysis gas collecting tube communicated with the coal material propulsion and pyrolysis passage provided on the kiln body; and a rotary scraper arranged on the inner wall of the kiln body, wherein the coal pyrolysis gas collecting tube is connected with a gas dust-trapping and liquefying device which is arranged outside the kiln body, and the flame-gas heating pipeline is rotatably arranged relative to the kiln body.

2. The vertical pyrolysis equipment for coal material according to claim 1, wherein the flame-gas heating pipeline comprises a fuel supply pipe, an air supply pipe, a combustion chamber and radiator pipes for flame-gas, and wherein an end of the flame-gas heating pipeline away from the combustion chamber forms a flame collection tube that extends outside the vertical kiln body.

3. The vertical pyrolysis equipment for coal material according to claim 2, wherein the radiator pipes for flame-gas are close-packed, the air supply pipe is communicated with a air distributary pipe, the fuel supply pipe is communicated with a fuel distributary pipe, the air distributary pipe is arranged parallel to the fuel distributary pipe and together with the combustion chamber to form a combustion unit, and the end of fuel distributary pipe close to the combustion chamber is communicated with the air distributary pipe.

4. The vertical pyrolysis equipment for coal material according to claim 1, wherein the flame-gas heating pipelinecomprises radiator pipes for flame-gas which are connected with the combustion chamber, the fuel supply pipe and the air supply pipe arranged outside the vertical kiln body.

5. The vertical pyrolysis equipment for coal material according to claim 1, wherein the coal pyrolysis gas collecting tube is communicated with the fuel supply pipe at the lower part of vertical kiln though a small diameter pipe having a valve, and one side of the fuel supply pipe is further provided with a starting fuel tank having a valve.

6. The vertical pyrolysis equipment for coal material according to claim 1, wherein the end of flame collection tube away from the radiator pipes for flame-gas is connected with a preheating and drying mechanism for pulverized coal.

7. The vertical pyrolysis equipment for coal material according to claim 5, wherein the end of flame collection tube away from the radiator pipes for flame-gas is connected with a preheating and drying mechanism for pulverized coal.

8. The vertical pyrolysis equipment for coal material according to claim 1, wherein the radiator pipes for flame-gas are close-packed pipes in cylinder reticulation.

9. The vertical pyrolysis equipment for coal material according to claim 8, wherein the coal pyrolysis gas collecting tube is communicated with the fuel supply pipe at the lower part of vertical kiln though a small diameter pipe having a valve, and one side of the fuel supply pipe is further provided with a starting fuel tank having a valve.

10. The vertical pyrolysis equipment for coal material according to claim 8, wherein the end of flame collection tube away from the radiator pipes for flame-gas is connected with a preheating and drying mechanism for pulverized coal.

11. The vertical pyrolysis equipment for coal material according to claim 2, wherein the coal pyrolysis gas collecting tube is communicated with the fuel supply pipe at the lower part of vertical kiln though a small diameter pipe having a valve, and one side of the fuel supply pipe is further provided with a starting fuel tank having a valve.

12. The vertical pyrolysis equipment for coal material according to claim 3, wherein the coal pyrolysis gas collecting tube is communicated with the fuel supply pipe at the lower part of vertical kiln though a small diameter pipe having a valve, and one side of the fuel supply pipe is further provided with a starting fuel tank having a valve.

13. The vertical pyrolysis equipment for coal material according to claim 4, wherein the coal pyrolysis gas collecting tube is communicated with the fuel supply pipe at the lower part of vertical kiln though a small diameter pipe having a valve, and one side of the fuel supply pipe is further provided with a starting fuel tank having a valve.

14. The vertical pyrolysis equipment for coal material according to claim 2, wherein the end of flame collection tube away from the radiator pipes for flame-gas is connected with a preheating and drying mechanism for pulverized coal.

15. The vertical pyrolysis equipment for coal material according to claim 3, wherein the end of flame collection tube away from the radiator pipes for flame-gas is connected with a preheating and drying mechanism for pulverized coal.

16. The vertical pyrolysis equipment for coal material according to claim 4, wherein the end of flame collection tube away from the radiator pipes for flame-gas is connected with a preheating and drying mechanism for pulverized coal.

17. The vertical pyrolysis equipment for coal material according to claim 9, wherein the end of flame collection tube away from the radiator pipes for flame-gas is connected with a preheating and drying mechanism for pulverized coal.

* * * * *